US006490885B1

(12) United States Patent
Wilkinson

(10) Patent No.: US 6,490,885 B1
(45) Date of Patent: Dec. 10, 2002

(54) ENERGIZED BODY JEWELRY AND ACCESSORIES

(75) Inventor: William R. Wilkinson, Scottsdale, AZ (US)

(73) Assignee: JJK Industries, L.P., Austin, TX (US)

( * ) Notice: Subject to any disclaimer, the term of this patent is extended or adjusted under 35 U.S.C. 154(b) by 141 days.

(21) Appl. No.: 09/704,207

(22) Filed: Nov. 1, 2000

Related U.S. Application Data

(63) Continuation-in-part of application No. 09/571,986, filed on May 16, 2000, now Pat. No. 6,382,815.

(51) Int. Cl.[7] ..... A44C 13/00

(52) U.S. Cl. ..... 63/1.11; 362/104; 362/253; 601/70

(58) Field of Search ..... 63/1.11, 2, 31; 601/46, 67, 70, 72; 362/104, 253

(56) References Cited

U.S. PATENT DOCUMENTS

| | | | | | |
|---|---|---|---|---|---|
| 859,674 | A | * | 7/1907 | Lindstrom | 310/50 |
| 3,362,401 | A | * | 1/1968 | Katz | 601/46 |
| 3,504,665 | A | * | 4/1970 | Bakunin et al. | 175/55 |
| 3,779,238 | A | * | 12/1973 | Cutler et al. | 601/154 |
| 3,900,023 | A | * | 8/1975 | McBride | 600/38 |
| 3,991,751 | A | * | 11/1976 | O'Rourke | 600/38 |
| RE29,687 | E | * | 7/1978 | Sertich | 32/56 |
| 5,622,062 | A | * | 4/1997 | Gong-Hwa | 63/1.13 |
| 5,660,597 | A | | 8/1997 | Fox et al. | 601/49 |
| 5,857,984 | A | * | 1/1999 | deBoer et al. | 340/573.1 |
| 6,203,509 | B1 | | 3/2001 | Duboff | 601/70 |
| 6,382,815 | B1 | * | 5/2002 | Klearman et al. | 362/104 |
| 6,419,649 | B1 | | 7/2002 | Klein | 601/70 |
| 2001/0047664 | A1 | | 12/2001 | Andrews et al. | 63/31 |
| 2002/0041159 | A1 | | 4/2002 | Kaping, Jr. | 315/56 |

FOREIGN PATENT DOCUMENTS

| | | |
|---|---|---|
| WO | WO 01/76685 A2 | 10/2001 |
| WO | WO 02/29313 A1 | 4/2002 |

* cited by examiner

*Primary Examiner*—Stephen Husar
(74) *Attorney, Agent, or Firm*—Charles J. Rogers

(57) ABSTRACT

Energized body jewelry including alternative embodiments designed to be worn by persons who have piercings in their bodies, as well as for those who do not have piercings. In one embodiment, the jewelry may be worn by a person with a piercing by attaching the jewelry with a barbell style piercing including a drilled retainer sized to carry the jewelry. In an alternative embodiment, through the use of a drilled elastomeric band, the jewelry may be worn by a person who does not have a piercing. The jewelry is energized such that it may vibrate, illuminate, or perform other functions requiring energy from some extracorporeal source such as a battery.

8 Claims, 6 Drawing Sheets

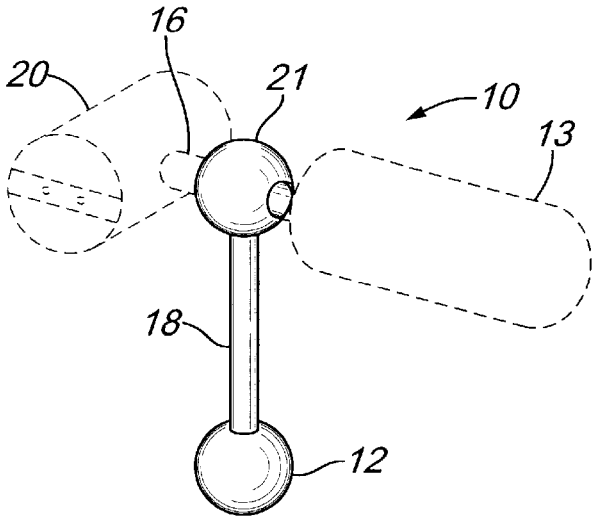
FIG. 1
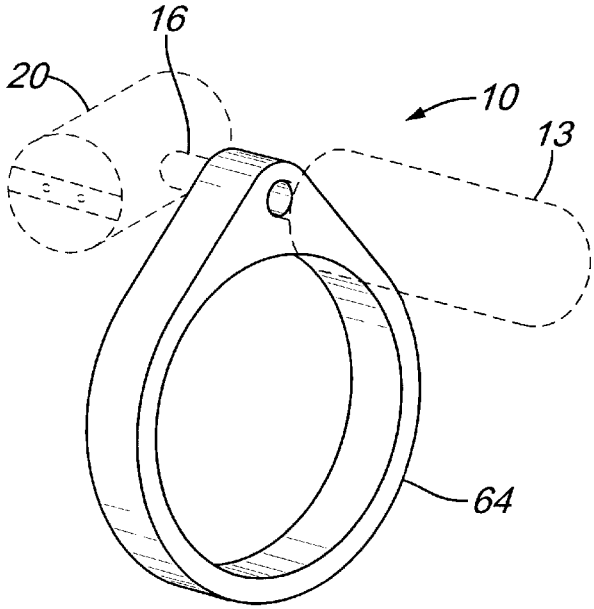
FIG. 2
FIG. 3
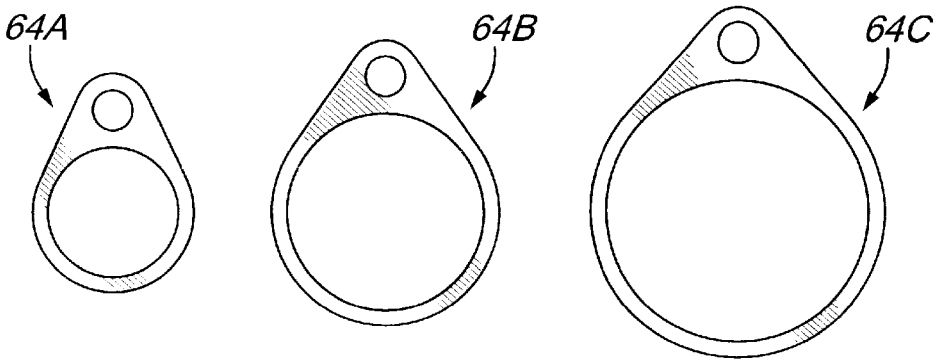

ENERGIZED BODY JEWELRY AND ACCESSORIES

CROSS-REFERENCE TO RELATED APPLICATIONS

This application is a continuation-in-part of U.S. patent application Ser. No. 09/571,986, entitled Energized Body Jewelry, filed on May 16, 2000, now U.S. Pat. No. 6,382,815, the disclosure of which is hereby incorporated by reference as if fully set forth herein.

BACKGROUND AND SUMMARY

The present invention relates generally to body jewelry including alternative embodiments designed to be worn by persons who have piercings in their bodies as well as for those who do not. Although body piercing in today 's society has been shifting from a counterculture dominated practice to an increasingly popular activity, a substantial number of persons who could be inclined to join the body piercing community are not quite ready to take that leap. The present invention provides unique energized body jewelry that can be worn by members of the piercing community, but also provides an alternative embodiment that can be worn by those who have not had their bodies pierced.

In one embodiment, the jewelry may be worn by a person with a piercing by attaching the jewelry with a standard barbell stud style piercing including a drilled retainer sized to carry the jewelry. In an alternative embodiment, through the use of a drilled elastomeric band, the jewelry may be worn by a person who does not have a piercing. The jewelry is energized such that it may vibrate, illuminate, or perform other functions requiring energy from some extracorporeal source such as a battery.

The energizing feature of the invention provides for many alternative uses ranging from the primarily ornamental aspect of an embodiment including an illuminating light source, to the more functional aspects provided through the preferred embodiment including a vibrator. A further embodiment of the invention includes accessories comprising sheaths with alternative configurations designed to cover at least a portion of the body jewelry and provide varying surface features for the jewelry.

The objects and potential uses of the present invention will become readily apparent upon further review of the following description, and various other features and attendant advantages will become more fully appreciated as the invention becomes better understood when considered in conjunction with the accompanying drawings, in which like reference characters designate the same or similar parts throughout the several views.

BRIEF DESCRIPTION OF THE DRAWINGS

FIG. 1 is a perspective view of an embodiment of the invention including a standard barbell stud with a drilled retainer.

FIG. 2 is a perspective view of an embodiment of the invention including a drilled elastomeric band.

FIG. 3 is a view of three alternative sizes for the drilled elastomeric band.

DETAILED DESCRIPTION

Figure 4:
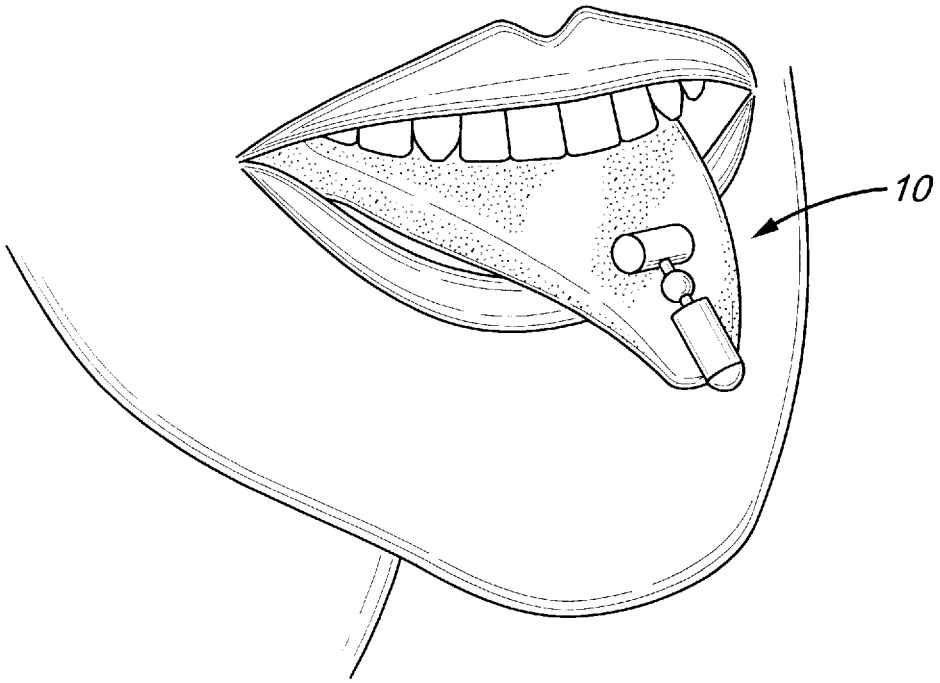
FIG. 4 is a perspective view of an embodiment of the invention attached to a person's pierced tongue with a standard barbell stud with a drilled retainer.

FIG. 1 is a perspective view of an embodiment of the invention including a standard barbell stud with a drilled retainer. Jewelry 10 is shown in FIG. 1 as generally comprising vibrator housing 16, vibrator motor cap 13, and battery housing 20. Jewelry 10 is shown in FIG. 1 attached to a standard barbell stud 18 by inserting vibrator housing 16 through a drilled hole in retainer 21. Retainer 21 is removably attached to the upper end of barbell stud 18, and a second retainer 12 is removably attached to the lower end of barbell stud 18.

FIG. 2 is a perspective view of an embodiment of the invention including a drilled elastomeric band. Jewelry 10 is shown in FIG. 2 attached to an elastomeric band 64 by inserting vibrator housing 16 through a drilled hole in elastomeric band 64. FIG. 3 is a view of three alternative sizes for the drilled elastomeric band 64.

Figure 5:
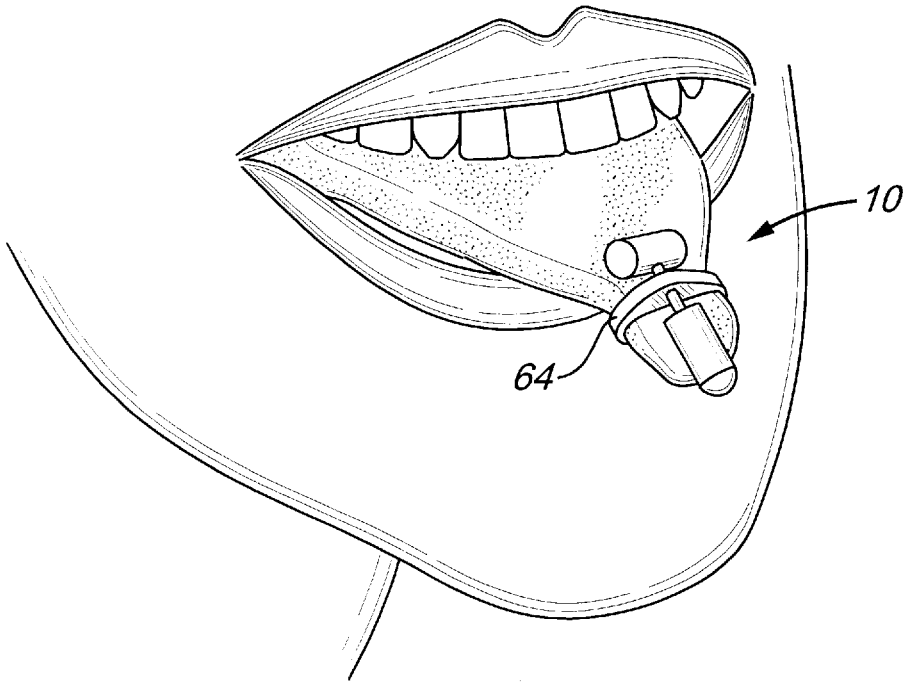
FIG. 5 is a perspective view of an embodiment of the invention attached to a person's tongue with a drilled elastomeric band.
Figure 6:
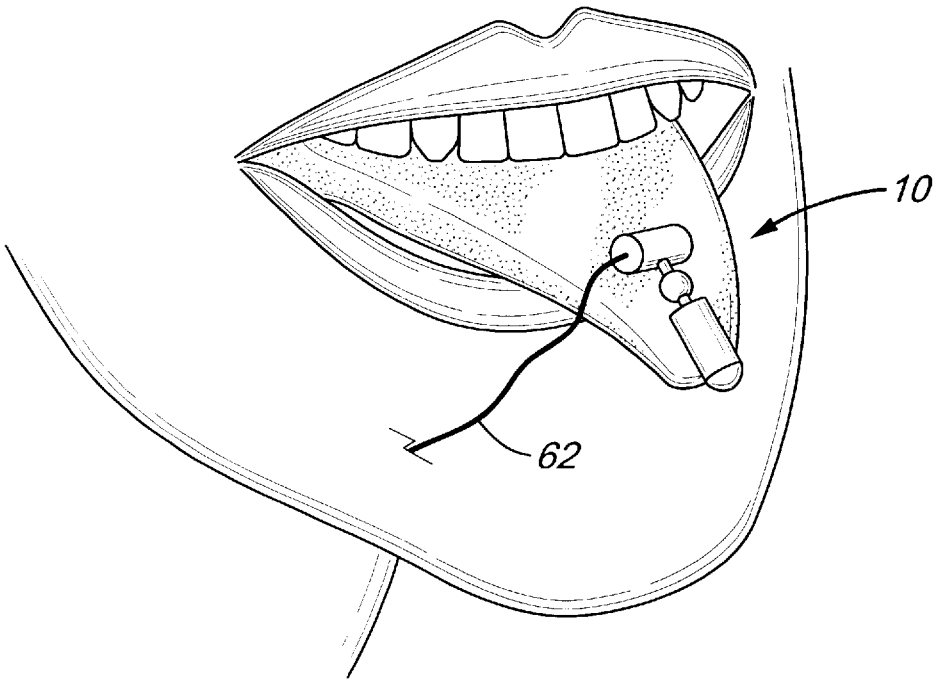
FIG. 6 is a perspective view of an embodiment of the invention attached to a person's pierced tongue with a standard barbell stud with a drilled retainer and utilizing an external power source.
Figure 7:
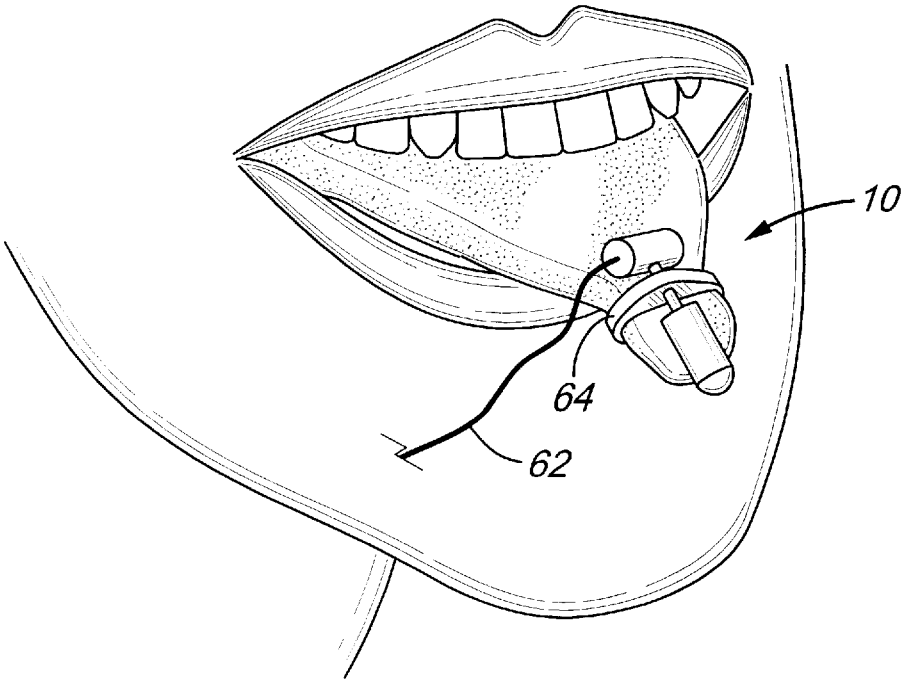
FIG. 7 is a perspective view of an embodiment of the invention attached to a person's tongue with a drilled elastomeric band and utilizing an external power source.

As shown in FIGS. 4 and 6, jewelry 10 can be worn as a barbell style tongue piercing by attaching jewelry 10 to a standard barbell stud with a drilled retainer 21. Alternatively, as shown in FIGS. 5 and 7, jewelry 10 can be worn by a person without a pierced tongue by using the drilled elastomeric band 64.

Figure 8:
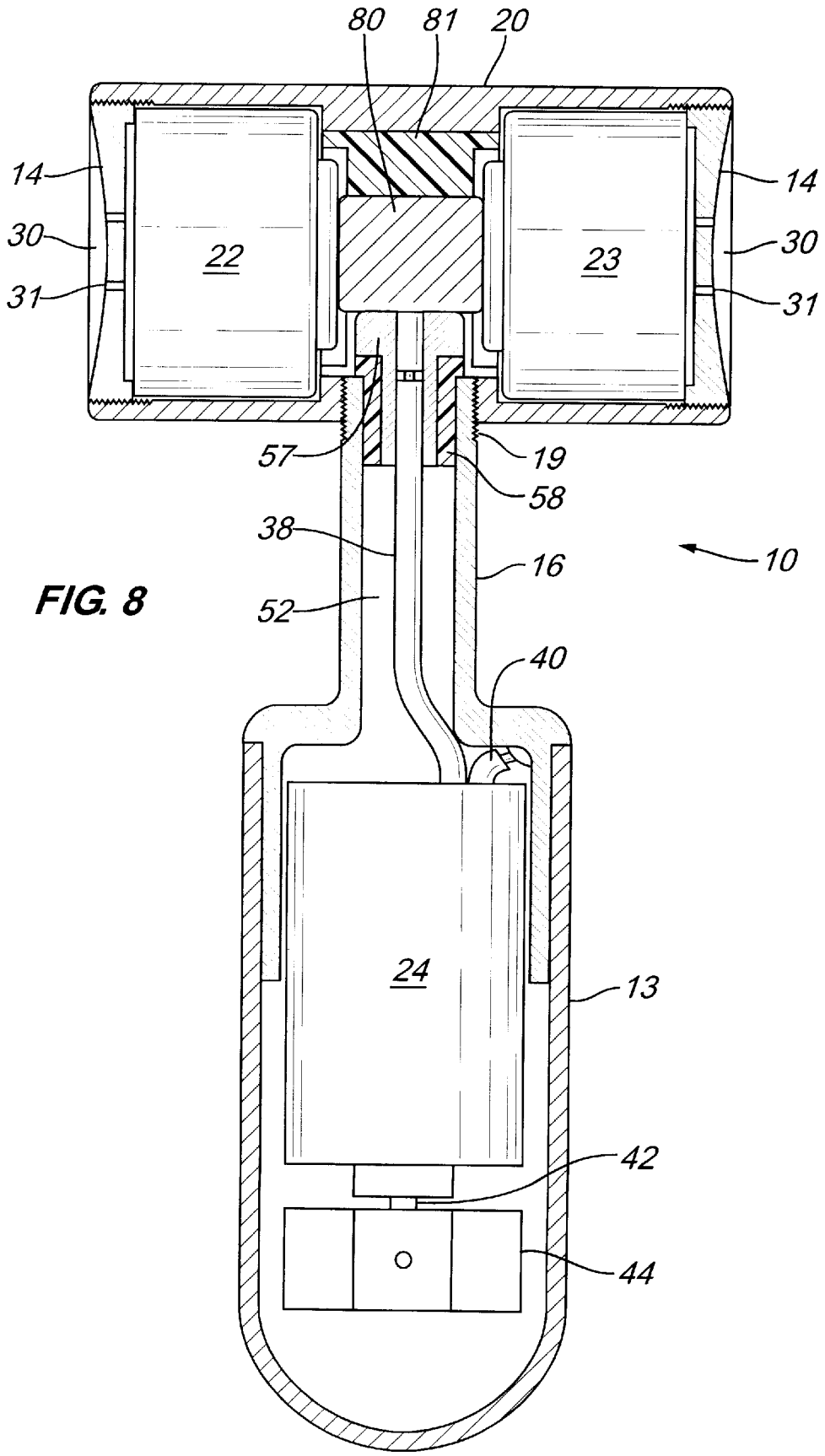
FIG. 8 is a cross-sectional view of an embodiment of the invention.

FIG. 8 is a cross-sectional view of an embodiment of the invention that includes two batteries in battery housing 20. Jewelry 10 is shown in FIG. 8 as comprised of vibrator housing 16, vibrator motor cap 13, and battery housing 20. In this embodiment, batteries 22 and 23 are located within battery housing 20. Battery end caps 14 are screwed into place with the help of battery end cap slots 30, which further include vent holes 31 to allow air to energize the batteries. The vibrator is comprised of electromagnetic motor 24, rotor shaft 42, and eccentric rotor 44. Motor 24 is secured within vibrator housing 16, and enclosed by vibrator motor cap 13.

As shown in FIG. 8, batteries 22 and 23 are connected in parallel to motor 24. Batteries 22 and 23 are placed into battery housing 20 with the cathode negative electrode end first. The cathode negative electrode ends of batteries 22 and 23 communicate through battery housing cathode 80. The cathode negative electrode ends of batteries 22 and 23, and battery housing cathode 80, are insulated from the battery housing 20 by cathode insulator 81. Positive lead wire 40 from motor 24 is attached to the inner periphery of vibrator housing 16. Negative lead wire 38 is fed through passage 52 in vibrator housing 16, where it terminates at vibrator housing cathode 57. Vibrator housing cathode 57 is insulated from vibrator housing 16 by vibrator housing insulator 58.

As further shown in FIG. 8, the threaded terminal end 19 of vibrator housing 16 is screwed into battery housing 20. When vibrator housing 16 is screwed into place, the parallel circuit between batteries 22 and 23, and motor 24, is completed as the negative ends of batteries 22 and 23 within battery housing 20 communicate through battery housing cathode 80 to vibrator housing cathode 57. When vibrator housing 16 is screwed into place, the positive anode ends of batteries 22 and 23 communicate with positive motor lead wire 40 through vibrator housing 16, battery housing 20, and battery end caps 14.

A person wearing jewelry 10 as a barbell style tongue piercing may turn on the vibrator by screwing down vibrator housing 16 to the point at which its vibrator housing cathode 57 engages battery housing cathode 80, and then turn off the vibrator by slightly backing off the threads of vibrator housing 16. This inventive on-off switch feature limits the necessary moving parts of the design to none other than the vibrator itself.

FIG. 4 shows a person wearing this battery powered embodiment of jewelry 10 as a barbell style tongue piercing by attaching jewelry 10 to a standard barbell stud with a drilled retainer 21. FIG. 5 shows a person without a pierced tongue wearing this battery powered embodiment of jewelry 10 by using the drilled elastomeric band 64.

Figure 9:
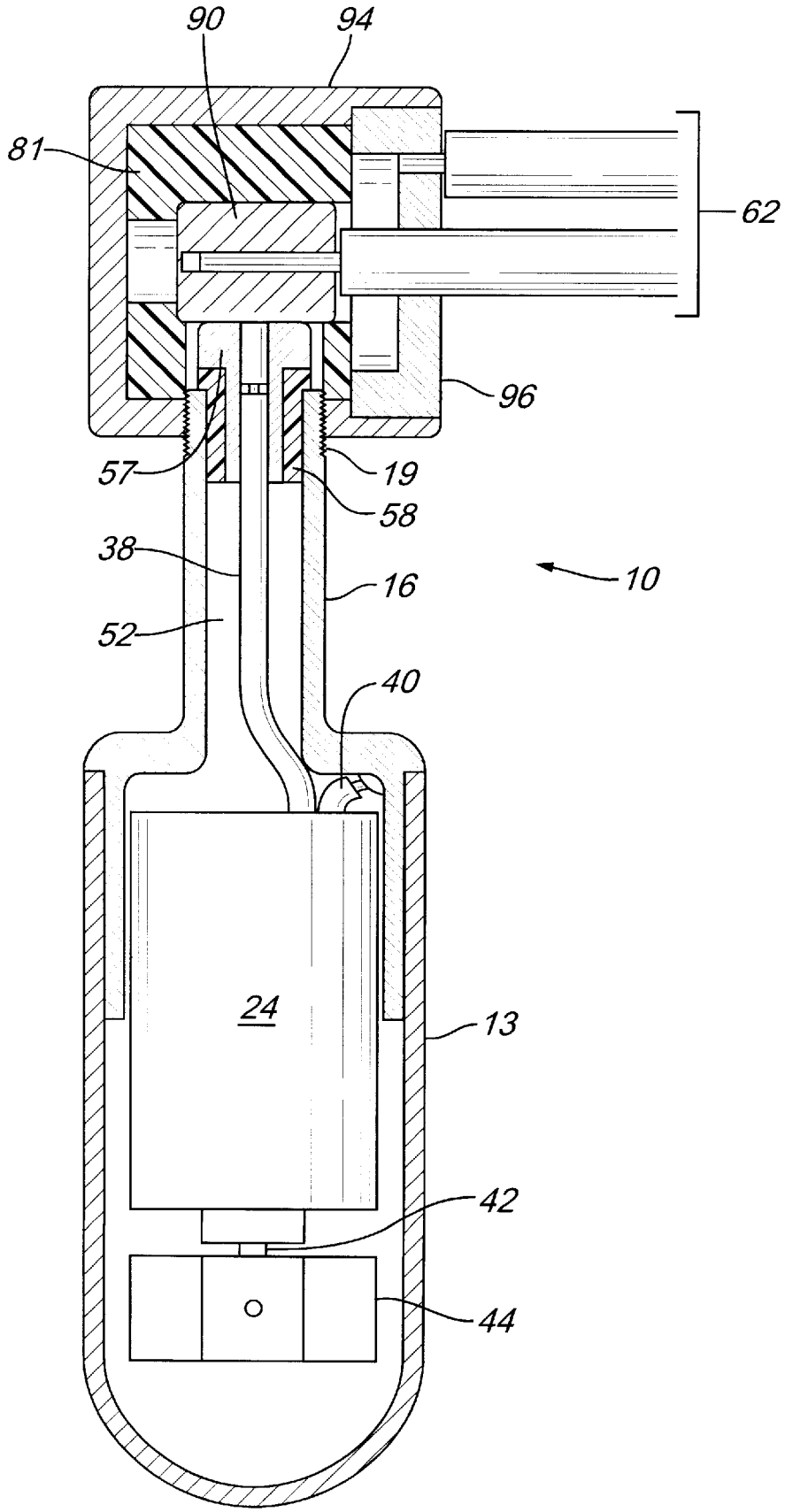
FIG. 9 is a cross-sectional view of an embodiment of the invention utilizing an external power source.
Figure 10A:
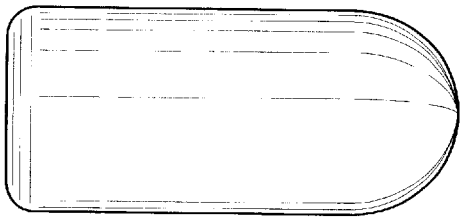
FIG. 10A is a side view of an alternative configuration of the sheath accessory embodiment of the invention.
Figure 10B:
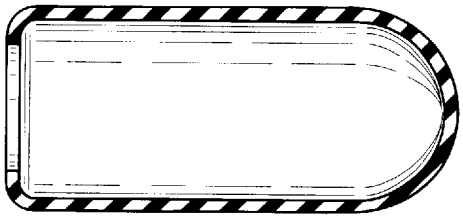
FIG. 10B is a cross-sectional view of an alternative configuration of the sheath accessory embodiment of the invention.
Figure 11A:
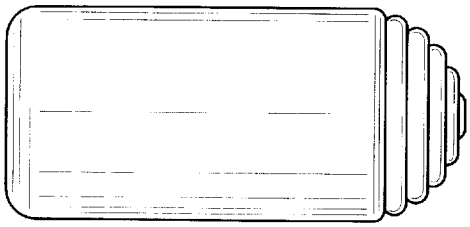
FIG. 11A is a side view of an alternative configuration of the sheath accessory embodiment of the invention.
Figure 11B:
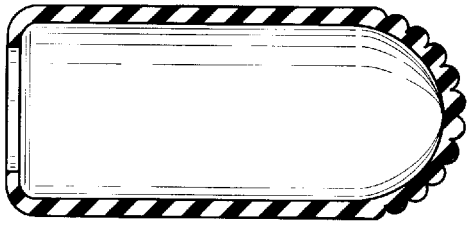
FIG. 11B is a cross-sectional view of an alternative configuration of the sheath accessory embodiment of the invention.
Figure 12A:
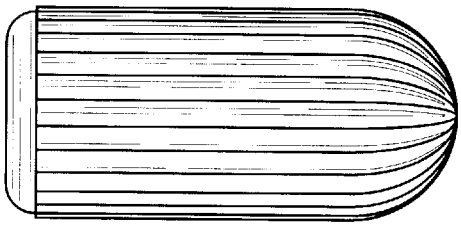
FIG. 12A is a side view of an alternative configuration of the sheath accessory embodiment of the invention.
Figure 12B:
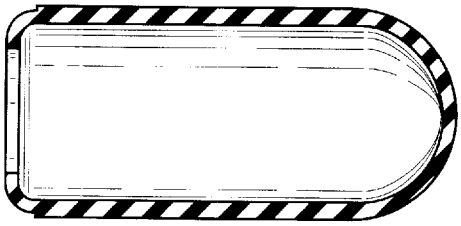
FIG. 12B is a cross-sectional view of an alternative configuration of the sheath accessory embodiment of the invention.
Figure 13A:
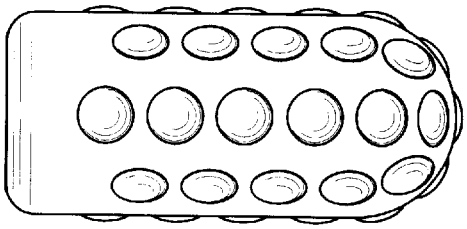
FIG. 13A is a side view of an alternative configuration of the sheath accessory embodiment of the invention.
Figure 13B:
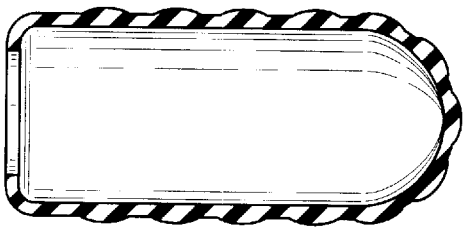
FIG. 13B is a cross-sectional view of an alternative configuration of the sheath accessory embodiment of the invention.

FIG. 9 is a cross-sectional view of an externally powered embodiment of the invention. Jewelry 10 is shown in FIG. 9 as comprised of vibrator housing 16, vibrator motor cap 13, power adapter body 94, and external wires 62. In this embodiment, power adapter body 94 provides a connection between the vibrator and an external power supply. The vibrator is comprised of electromagnetic motor 24, shaft 42, and eccentric rotor 44. Motor 24 is secured within vibrator housing 16, and enclosed by vibrator motor cap 13. Positive lead wire 40 from motor 24 is attached to the inner periphery of vibrator housing 16. Negative lead wire 38 is fed through passage 52 in vibrator housing 16, where it terminates at vibrator housing cathode 57. Vibrator housing cathode 57 is insulated from vibrator housing 16 by vibrator housing insulator 58.

As further shown in FIG. 9, the threaded terminal end 19 of vibrator housing 16 is screwed into power adapter body 94. When vibrator housing 16 is screwed into place, the circuit between motor 24 and an external power supply connected to wires 62 is completed as the negative lead of wires 62 communicates with vibrator housing cathode 57 through power adapter body cathode 90. When vibrator housing 16 is screwed into place, the positive lead of wires 62 communicates with positive motor lead wire 40 through vibrator housing 16, power adapter body 94, and power adapter anode 96. The cathode negative electrode lead of wires 62, power adapter cathode 90, and vibrator housing cathode 57, are insulated from the power adapter body 94 by cathode insulator 81.

A person wearing jewelry 10 as a barbell style tongue piercing may turn on the vibrator by screwing down vibrator housing 16 to the point at which its vibrator housing cathode 57 engages power adapter cathode 90, and then turn off the vibrator by slightly backing off the threads of vibrator housing 16. This inventive on-off switch feature limits the necessary moving parts of the design to none other than the vibrator itself.

FIG. 6 shows a person wearing this externally powered embodiment of jewelry 10 as a barbell style tongue piercing by attaching jewelry 10 to a standard barbell stud with a drilled retainer 21. FIG. 7 shows a person without a pierced tongue wearing this externally powered embodiment of jewelry 10 by using the drilled elastomeric band 64.

A further embodiment of the invention includes accessories comprising sheaths with alternative configurations designed to cover at least a portion of the body jewelry and provide varying surface features for the jewelry.

FIGS. 10A through 13A are side views of alternative configurations of sheaths designed as accessories for the energized body jewelry. FIGS. 10B through 13B are cross-sectional views of each of these alternative configurations of sheath accessories. The sheaths are designed to cover at least a portion of the vibratory housing of the energized body jewelry and provide varying surface features for the jewelry. As can be seen in the drawings, each of these alternative configurations provides for a unique surface configuration to enhance the functional aspects of the jewelry. In addition, the sheaths may function as a protective covering for the energized body jewelry by reducing the surface hardness of the jewelry and softening the impact of the jewelry when it contacts a person's teeth or other sensitive areas of the body.

Further alternative embodiments of this invention, which would be apparent to those skilled in the art, include the placement of this inventive jewelry on parts of the body other than the tongue, the modification of the vibrator mechanism to include any of several known alternative structures for creating vibrations, and the use of light emitters in addition to or in place of the vibrator mechanism.

It is to be understood that the present invention is not limited to the embodiments described above, but encompasses any and all embodiments within the scope of the following claims.

I claim:

1. An apparatus comprising:

a first housing body with a terminal end;

the first housing body enclosing a vibrator;

the terminal end of the first housing body connected to a second housing;

the second housing enclosing a power source;

the first housing body removably connected to a drilled retainer;

the drilled retainer removably connected to a barbell stud; and the barbell stud removably connected to a second retainer.

2. An apparatus comprising:

a first housing body with a terminal end;

the first housing body enclosing a vibrator;

the terminal end of the first housing body connected to a second housing;

the second housing connected to an external power source;

the first housing body removably connected to a drilled retainer;

the drilled retainer removably connected to a barbell stud; and the barbell stud removably connected to a second retainer.

3. An apparatus comprising:

a first housing body with a terminal end;

the first housing body enclosing a vibrator;

the terminal end of the first housing body connected to a second housing;

the second housing enclosing a power source; and the first housing body removably connected to a drilled elastomeric band.

4. An apparatus comprising:

a first housing body with a terminal end;

the first housing body enclosing a vibrator;

the terminal end of the first housing body connected to a second housing;

the second housing connected to an external power source; and the first housing body removably connected to a drilled elastomeric band.

5. An apparatus according to claim 1 further comprising:

a sheath enclosing at least a portion of the first housing body.

6. An apparatus according to claim 2 further comprising:

a sheath enclosing at least a portion of the first housing body.

7. An apparatus according to claim 3 further comprising:

a sheath enclosing at least a portion of the first housing body.

8. An apparatus according to claim 4 further comprising:

a sheath enclosing at least a portion of the first housing body.

* * * * *